US010436389B2

(12) United States Patent
Kegler

(10) Patent No.: US 10,436,389 B2
(45) Date of Patent: Oct. 8, 2019

(54) PROCESSING SYSTEM

(71) Applicant: Eminent Technologies, LLC, Naperville, IL (US)

(72) Inventor: Andrew Kegler, Ripon, WI (US)

(73) Assignee: EMINENT TECHNOLOGIES, LLC, Naperville, IL (US)

( * ) Notice: Subject to any disclaimer, the term of this patent is extended or adjusted under 35 U.S.C. 154(b) by 380 days.

(21) Appl. No.: 14/746,354

(22) Filed: Jun. 22, 2015

(65) Prior Publication Data

US 2015/0369424 A1 Dec. 24, 2015

Related U.S. Application Data

(60) Provisional application No. 62/015,849, filed on Jun. 23, 2014.

(51) Int. Cl.

| | |
|---|---|
| ***B08B 3/14*** | (2006.01) |
| ***B08B 7/00*** | (2006.01) |
| ***F17C 7/02*** | (2006.01) |
| ***D06F 43/08*** | (2006.01) |

(52) U.S. Cl.

CPC ..... *F17C 7/02* (2013.01); *B08B 7/0021* (2013.01); *D06F 43/081* (2013.01); *B08B 3/14* (2013.01); *F17C 2201/0166* (2013.01); *F17C 2201/0171* (2013.01); *F17C 2227/0346* (2013.01); *F17C 2265/015* (2013.01)

(58) Field of Classification Search

CPC ..... F17C 7/02; F17C 2227/0346; F17C 2201/0171; F17C 2201/0166; F17C 2265/015; B08B 7/0021; B08B 3/14; D06F 43/081

See application file for complete search history.

(56) References Cited

U.S. PATENT DOCUMENTS

| | | | | |
|---|---|---|---|---|
| 5,380,826 | A * | 1/1995 | Castor | C12N 1/066 435/270 |
| 5,620,728 | A * | 4/1997 | Langley | B01D 11/023 426/312 |
| 5,783,243 | A * | 7/1998 | Benado | A23L 5/23 426/425 |
| 6,558,432 | B2 | 5/2003 | Schulte | |
| 6,638,560 | B2 * | 10/2003 | Benado | A23L 5/23 426/429 |
| 6,749,816 | B1 * | 6/2004 | Hasegawa | B01J 3/008 422/105 |
| 6,755,871 | B2 | 6/2004 | Damaso | |
| 6,851,148 | B2 | 2/2005 | Preston | |
| 6,982,007 | B2 * | 1/2006 | Worm | D06F 43/00 134/11 |
| 2002/0045347 | A1 * | 4/2002 | Worm | D06F 43/00 438/689 |
| 2005/0210701 | A1 * | 9/2005 | Kanda | B01D 11/028 34/330 |
| 2006/0112738 | A1 * | 6/2006 | Worm | D06F 43/00 68/18 R |

(Continued)

*Primary Examiner* — Alexander Markoff

(74) *Attorney, Agent, or Firm* — Jeffer Mangels; Butler & Mitchell LLP; Brennan C. Swain, Esq.

(57) ABSTRACT

A system for processing objects to be cleaned that includes a processing vessel, and a storage vessel that includes an upper section for storing clean liquid and a lower section for storing dirty liquid. The upper section and lower section are in flow communication.

8 Claims, 5 Drawing Sheets

(56) References Cited

U.S. PATENT DOCUMENTS

| | | | | |
|---|---|---|---|---|
| 2008/0233238 | A1* | 9/2008 | Roney | A23L 33/21<br>426/50 |
| 2009/0178693 | A1* | 7/2009 | Turner | B01D 53/00<br>134/10 |
| 2012/0060868 | A1* | 3/2012 | Gray | B08B 3/12<br>134/22.18 |
| 2013/0206645 | A1* | 8/2013 | Yarbro | C10G 31/08<br>208/106 |
| 2015/0013216 | A1* | 1/2015 | Shaffer | C10L 9/08<br>44/629 |
| 2015/0114034 | A1* | 4/2015 | Higginbotham | B01D 53/002<br>62/617 |
| 2015/0152342 | A1* | 6/2015 | Miller | C10G 47/34<br>208/97 |

* cited by examiner

PROCESSING SYSTEM

CROSS REFERENCE TO RELATED APPLICATIONS

This application claims the benefit of U.S. Provisional Application No. 62/015,849, filed Jun. 23, 2014, which is incorporated by reference herein in its entirety.

FIELD OF THE INVENTION

The present invention relates generally to a carbon dioxide processing system, and more particularly to a carbon dioxide processing system for use in dry cleaning operations.

BACKGROUND OF THE INVENTION

In a typical carbon dioxide processing system, the carbon dioxide is held at pressures and temperatures to maintain a liquid or supercritical state of the carbon dioxide. When the liquid carbon dioxide is used for a typical processing application, the liquid is removed from a processing vessel which is suitable for the pressures involved which can be 600 psi or higher. The processing vessel will maintain the pressure, but contains only a gas phase of the carbon dioxide. In a typical processing system, a compressor is used to evacuate the remaining carbon dioxide gas from the processing vessel and return it to a storage tank or condensing heat exchanger for reuse. To counteract the thermodynamic properties of the reduction of pressure in a fixed volume vessel, heat is added to the vessel at a rate consistent with the heat transfer properties. For prior art carbon dioxide cleaning systems, see, for example, U.S. Pat. No. 6,851,148 to Preston, issued on Feb. 8, 2005, U.S. Pat. No. 6,755,871, issued on Jun. 29, 2004 to R.R. Street & Co. Inc., and U.S. Pat. No. 6,558,432 issued on May 6, 2003 to R.R. Street & Co. Inc., the entireties of which are incorporated herein by reference.

SUMMARY OF THE PREFERRED EMBODIMENTS

In accordance with an aspect of the present invention there is provided a system for processing objects to be cleaned that includes a processing vessel, and a storage vessel that includes an upper section for storing clean liquid and a lower section for storing dirty liquid. The upper section and lower section are in flow communication. In a preferred embodiment, the upper section and lower section are in flow communication by a standpipe. Preferably, the upper section includes a first heat exchanger associated therewith that condenses gas received from the lower section to form clean liquid to be stored in the upper section. In a preferred embodiment, an overflow height is defined between a bottom of the upper section and a top of the standpipe. The upper section includes a storage portion that is configured to hold a predetermined volume of clean liquid, such that if an excess of clean liquid beyond the predetermined volume of clean liquid is present in the upper section, the excess of clean liquid flows over the top of the standpipe and into the lower section.

In a preferred embodiment, the lower section and upper section are separated by a dividing wall, and the overflow height is defined between the dividing wall and the top of the standpipe. Preferably, clean liquid flows to the process vessel via gravity, and dirty liquid flows to the lower section via gravity. In a preferred embodiment, the system also includes a first compressor, an accumulator vessel and a second compressor in flow communication between the processing vessel and the storage vessel. A gas flows from the processing vessel through the second compressor, through the accumulator vessel, through the first compressor and to the storage vessel. Preferably, the lower section includes a second heat exchanger for distilling the dirty liquid to form a gas that rises through the standpipe and into the upper section.

In accordance with another aspect of the present invention there is provided a method of processing objects that includes placing the objects in a processing vessel, flowing clean liquid from an upper section of a storage vessel to the processing vessel, processing the objects, flowing a dirty liquid from the processing liquid to a lower section of the storage vessel, distilling the dirty liquid such that gas is formed and rises from the lower section to the upper section, cooling the gas to reclaim at least a portion of the clean liquid, and storing the clean gas in the upper section. Preferably, the gas rises through a standpipe between the lower section and the upper section. In a preferred embodiment, clean liquid flows to the process vessel via gravity, and dirty liquid flows to the lower section via gravity.

In accordance with another aspect of the present invention there is provided a storage vessel for use in a carbon dioxide cleaning system that includes a storage vessel interior, a dividing wall spanning the storage vessel interior, an upper section for storing clean liquid, a lower section for storing dirty liquid that is positioned below the upper section, and a standpipe communicating the upper section and the lower section. Preferably, the upper section includes a first heat exchanger configured to condense gas received from the lower section thereby forming clean liquid to be stored in the upper section and the lower section includes a second heat exchanger for distilling the dirty liquid thereby forming a gas that rises through the standpipe and into the upper section. In a preferred embodiment, the bottom of the storage vessel is made of stainless steel, and an upper portion is made of carbon steel.

In accordance with another aspect of the present invention there is provided a system for processing objects to be cleaned that includes a processing vessel for processing the objects to be cleaned, a first storage section for storing clean liquid, a second storage section for storing dirty liquid, a first compressor, an accumulator vessel, and a second compressor. A first pressure path is defined from the processing vessel, through the first compressor and to the second storage section, and a second pressure path is defined from the processing vessel, through the second compressor, through the accumulator vessel, through the first compressor and to the second storage section.

In a preferred embodiment, gas at a first pressure is processed along the first pressure path, and gas at a second pressure is processed along the second pressure path. The second pressure is less than the first pressure. Preferably the second pressure is less than half of the first pressure. In a preferred embodiment, the first and second storage sections are contained within a single storage vessel.

In accordance with another aspect of the present invention there is provided a method of reducing the pressure of a gas that includes flowing the gas at a first pressure from a processing vessel along a first pressure path. The first pressure path is defined from the processing vessel, through a first compressor. Once the pressure of the gas has dropped to a predetermined second pressure, the method includes flowing the gas at the second pressure from the processing vessel along a second pressure path. The second pressure path is defined from the processing vessel, through a second compressor, through an accumulator vessel, and through the first compressor.

In a preferred embodiment of the present invention a series of gas holding tanks coupled with steady flow compressors are used to maintain a near constant pressure in the holding tanks at all times. When the processing cycle is complete and the liquid is removed from the processing vessel, the processing vessel is heated via direct contact with preferably either hot process gas, steam, or electric elements mounted within the processing vessel. The temperature is preferably maintained at a relatively steady rate and the pressure is held consistent with the distillation portion of the processing system, thereby decreasing the density of the carbon dioxide gas. The processing vessel is connected via valving and piping to the first stage of the constant pressure gas holding tank (storage vessel). The constant pressure gas holding tank is preferably of substantially larger volume than the processing vessel, which causes a pressure equalization between the two tanks at a value of at least about 0.5 and more preferably about 0.25 of the processing vessel operating pressure. The valve and piping arrangement are of large enough capacity as to allow the pressure equalization to occur in a matter of seconds or minutes. The first compressor operates between the first stage gas storage and the distillation vessel. In one preferred aspect of the invention, the gas is piped directly into the contaminated liquid thereby increasing the temperature of the liquid and collapsing the gas, and thereby further reducing the heat load on the entire system. The compressor of the first stage operates continually at an about 2:1 to about 4:1 compression ratio to maintain a relatively steady flow rate and pressure between the first stage storage tank and the distillation tank. The present invention preferably has at least one more gas stage but may have more than three. The second stage gas storage tank is held at the similar compression ratio of about 2:1 to about 4:1. This stage operates to facilitate cleaning contaminants from a solvent stream and then recaptures that solvent. The present invention preferably uses a dual heat source technique in one vessel to help first separate the contaminants from a wash solvent via distillation, and second to condense the clean solvent. Those skilled in the art are familiar with both the distillation and condensing phases of fluids and the basic technique of heating and cooling apply to the present invention. By combining the techniques into one vessel, cost improvements are realized. This is an important fact in the production of carbon dioxide processing systems since the pressures involved require heavy walled vessels.

A typical carbon dioxide processing system is comprised of a storage tank, a method of processing the contaminants from the carbon dioxide for reuse, and a processing vessel where the articles which require processing are placed. There are many auxiliary components to further reduce the overall operational cost of the process. One further benefit of this invention is the reduction of tank capacity to store the liquid carbon dioxide when compared to the prior art. In many carbon dioxide based processing systems, the storage vessel is used to hold both liquid and gas phases of the carbon dioxide. The gaseous side storage volume is typically used as an accumulator for the gas as the system operates a gas reclaim from the separate processing vessel. Compressors are used to reduce the pressure in the processing vessel and return it to the storage vessel and/or a condensing heat exchanger. The condensate is held in the storage tank along with the gaseous carbon dioxide. The present invention uses the condensing section of the single, multi-phase tank as the accumulator section of the process. Not only does this reduce the number of vessels required to operate the system, the storage capacity can be significantly reduced compared to the prior art because it is no longer required to perform the function of gas storage. However, this is not a limitation on the present invention and the storage capacity can be greater than the prior art, if desired.

Another advantage of this invention is the use of materials of construction. The more complete distillation and smaller storage requirements have reduced or eliminated the need for stainless steel storage tank components. The recent increase in the cost of stainless steel has had a major impact on the cost to produce carbon dioxide processing systems. By reducing the number of components that require stainless steel as the material of construction, the cost to produce the overall system is reduced. However, stainless steel can be used, if desired.

Another advantage of this invention is in the reduction of the detrimental effects of air entrained in the condensing section of the equipment when compared to the prior art. Air which gets trapped within the system tends to collect at the high points of any area it travels to. The air has a lower density than the carbon dioxide and it also has a lower condensation temperature of −360° F. for air verses 45° F. for carbon dioxide at the pressures typical of a carbon dioxide processing system. When air enters the system through the processing vessel during loading and unloading operations, if it is not completely removed, it will collect in the condenser area. This collection of air can reduce or stop the condensation of the gaseous carbon dioxide if the condensation temperature of the system is above the condensation temperature of air, which it most likely would be. The arrangement of the condensing section of the present invention allows the air to collect above the condensing area where it can be monitored and removed, if necessary, thereby eliminating the reduction in performance often associated with some carbon dioxide processing systems.

In some embodiments of the present invention, the separation plate between the evaporator section and the condensing section may contain a riser tube or pipe or some other type of vertical means to increase the height between the evaporator and condenser sections, thereby creating a substantial volume area for condensate to collect below the condenser section yet maintain separation from the evaporator section. In this arrangement of the present invention, the vessel has the ability to act as a distillation tank, a condensing heat exchanger, an air trap, and a clean liquid storage vessel. Since all of the vessels operate at generally the same pressure, the components used to separate and differentiate the sections can be made of non-pressure bearing material, thereby reducing the thickness required for the vessels which can translate to lower cost of the component. The vessel also preferably shares a common pressure relief valve that can further reduce the cost of the overall system. It will be understood that the cost saving examples are only exemplary and are not intended to be limiting. In other embodiments, the system can be made of materials or in sizes that result in a product more expensive than typical prior art systems. In another embodiment, the evaporator and distillation sections can be separate tanks connected by piping.

An exemplary use of the present invention will now be described. In use, articles to be processed are placed in the process vessel (PV). Liquid fills in from the top of the PV. It will be appreciated by those of ordinary skill in the art that the storage vessel (SV) is, in a preferred embodiment, a combination steel storage vessel (e.g., a double SV as shown in FIG. 1). The fluid comes from the top section of the SV and fills in to PV in a predetermined volume. The fluid is then recirculated to further solvate the material in the PV. The fluid then flows down, out a bottom valve into a pump and continues to be recirculated through PV for a predetermined amount of time. Once the material is satisfactorily solvated (e.g., the clothes are washed), the pump stops, a valve opens and the fluid gradually drains into the lower part of SV, i.e., the still section. The still separates out the two solvents (as described below). At this time, PV is still under pressure. In this example, 700 PSI is used. The valve on the top of PV is then opened so that gas can flow into compressor 2.

PV and SV are now at about the same pressure because they were just opened up together and they are gravity drained. Next, the first compressor turns on and starts increasing the pressure in SV while decreasing the pressure in PV. The compressor discharges gas into SV below the liquid level in the still portion to allow the liquid to capture the heat of compression from the first compressor. As the pressure difference between the two tanks increases, there is more and more heat transferred into the fluid. The heat is transferred into the fluid, which begins to distill. In other words, the gas from the compressor is collapsing, which causes the fluid in the bottom of SV to begin to distill. When the pressure reaches the predetermined point, which is preferably between about 700 PSI and 1200 PSI, the temperature switch and the pressure switch are switched on, which starts the cooling water going through the heat exchanger in the top of SV, which then condenses the gas that has risen to the top of SV back into a liquid.

It will be appreciate that two components were separated out in the PV: 1) The concentrated components (dirt, residue, etc.) in the articles in PV, and 2) liquid $CO_2$ which have both now drained to the SV bottom. Once there, the clean $CO_2$, distills off and is reclaimed as liquid in the top of SV. The clean $CO_2$ is reclaimed in the top to a set volume that is dictated by the height of the standpipe in the top of SV. Any additional liquid $CO_2$ spills back over the standpipe and into the still. After a predetermined amount of time there is a ratio, between about 2:1 to 4:1 on the first compressor. Therefore, because condensing is taking place in SV, the pressure stays at about 700 PSI. With a 2:1 ratio PV is now down to about 350 PSI. If this is the predetermined pressure that is chosen (it can be lower or higher, but 350 PSI is used in this example) the first compressor shuts off for a few moments, the valve is closed, and then gas is pulled from PV through the top and through a valve and into the second (low pressure) compressor. After going through the second compressor, the gas goes into the accumulator vessel (ACC). The gas exits ACC, goes through another valve and into the first (high pressure) compressor and then into SV.

Once PV and ACC are opened they equalize to the same pressure, which provides a set ratio between PV, ACC and then ACC to SV. At this point, both the ACC and SV are down to about a 4 to 1 ratio. For example, if SV climbs back up to about 800 PSI, ACC is at about 200 and PV is at about 50 PSI. If 50 PSI is a desired pressure at that point it is vented out.

By performing the above-described process with two separate tanks and having a large accumulator, compared to the prior art preferably the cycle time can be reduced by about 30%. However, this is only exemplary and not a limitation. At this point the clothes or other articles or substrates can be removed from PV.

PV can then be loaded with other articles. The first compressor can keep on working the whole time and bring ACC down to as low as about 8 to 1 (about 100 PSI in the example). At that point the first compressor can be stopped, the next cycle can be started and at the start of the next cycle ACC is at about 100 PSI. Then, from ACC the gas is fed through a valve and into the top of PV. Preferably, the pressure in PV and ACC are approximately balanced. In a preferred embodiment, ACC has a slightly larger volume than PV. However, they can also have the same volume or ACC can have a smaller volume than PV. If ACC has a slightly larger volume, PV and ACC balance at about ⅓, so about 33 PSI roughly in the example. Once PV is opened up, the pressure from ACC is used to purge out the air. In an embodiment, a burst can be used of 100% $CO_2$ from ACC to reduce PV to, e.g., 50% $CO_2$, 50% air, and then vent that back out through a valve. This can be done a few times to keep purging air out of PV and reducing the $CO_2$ and air concentration. Gas can then be vented from the top of SV through another valve. This drops the pressure again in SV, which causes anything left at the bottom of the still to continue to distill. It will be appreciated by those of ordinary skill in the art that instead of raising the temperature, the pressure is dropped, which has the same effect. This provides another boost to get the distillation started. It also helps get PV above 75 PSI. It will be appreciated that dry ice may form below 75 PSI if liquid carbon dioxide is introduced into the PV. The cycle is now ready for the next stage so liquid can be fed from SV to PV, which begins the next cycle.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
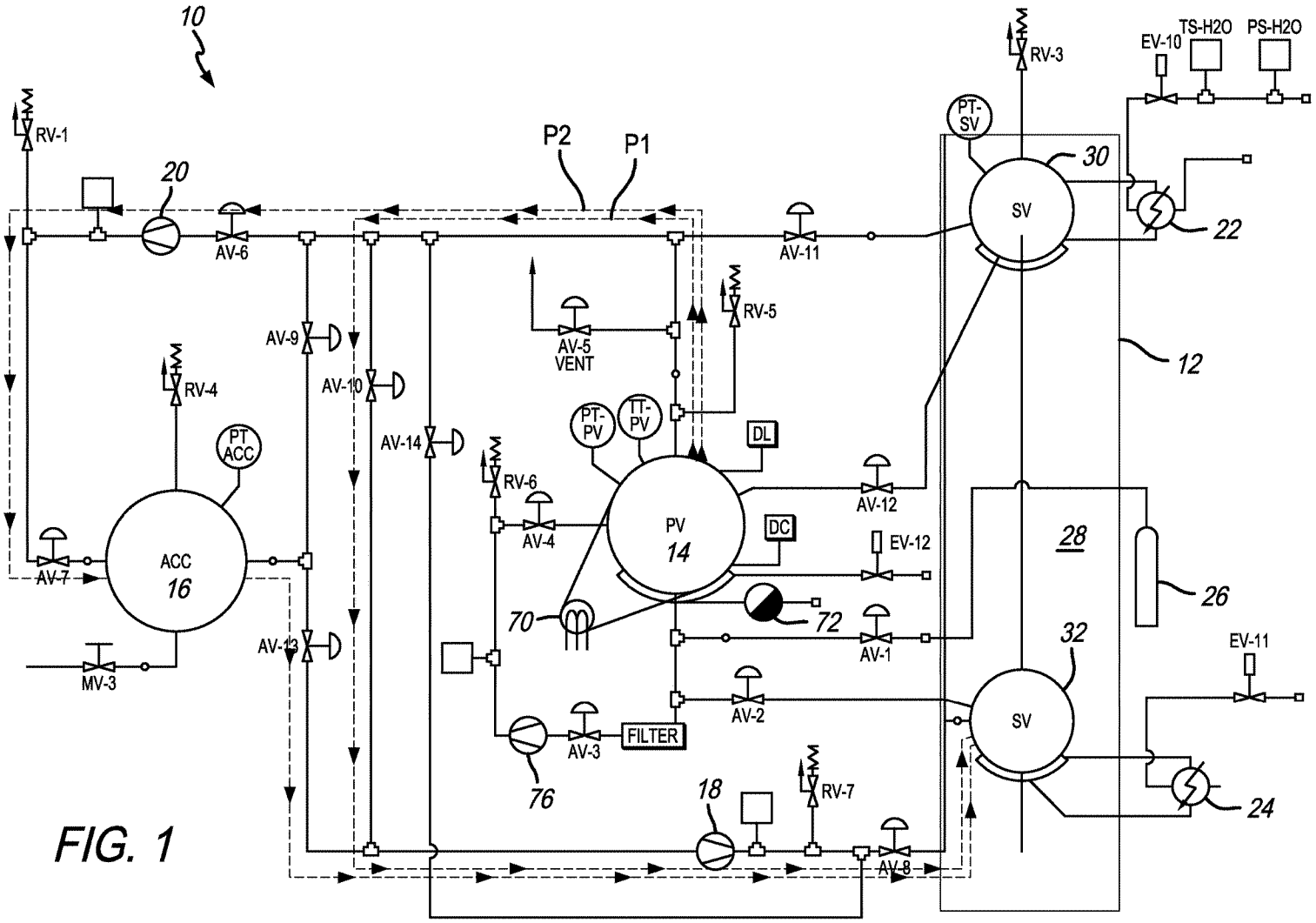
FIG. 1 is a schematic or plumbing and instrumentation diagram of the carbon dioxide processing system.

The following description and drawings are illustrative and are not to be construed as limiting. Numerous specific details are described to provide a thorough understanding of the disclosure. However, in certain instances, well-known or conventional details are not described in order to avoid obscuring the description. References to one or an other embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. Appearances of the phrase "in one embodiment" in various places in the specification do not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Figure 2:
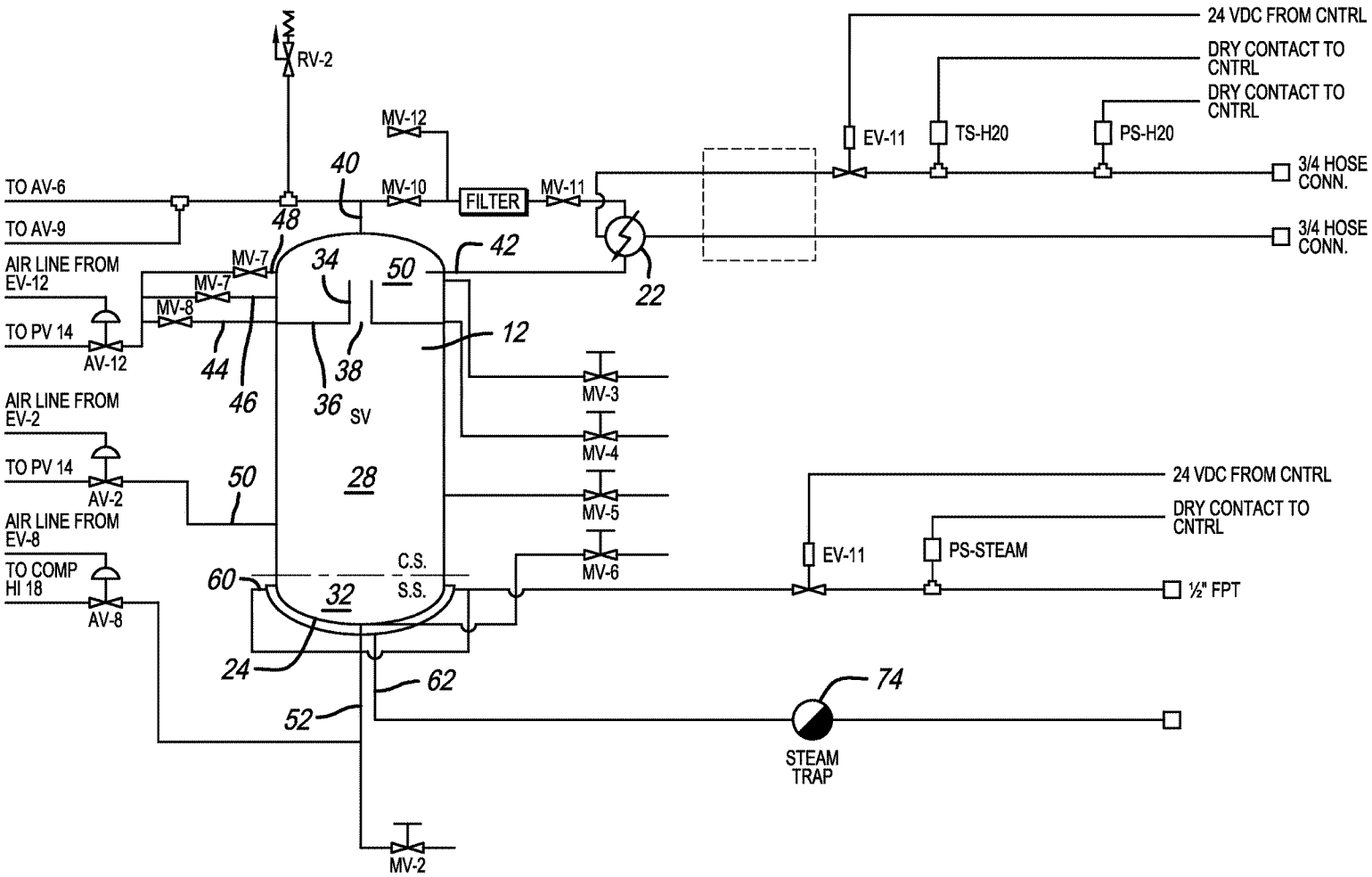
FIG. 2 is a schematic or plumbing and instrumentation diagram of the storage vessel and associated components of the carbon dioxide processing system of FIG. 1.
Figure 3:
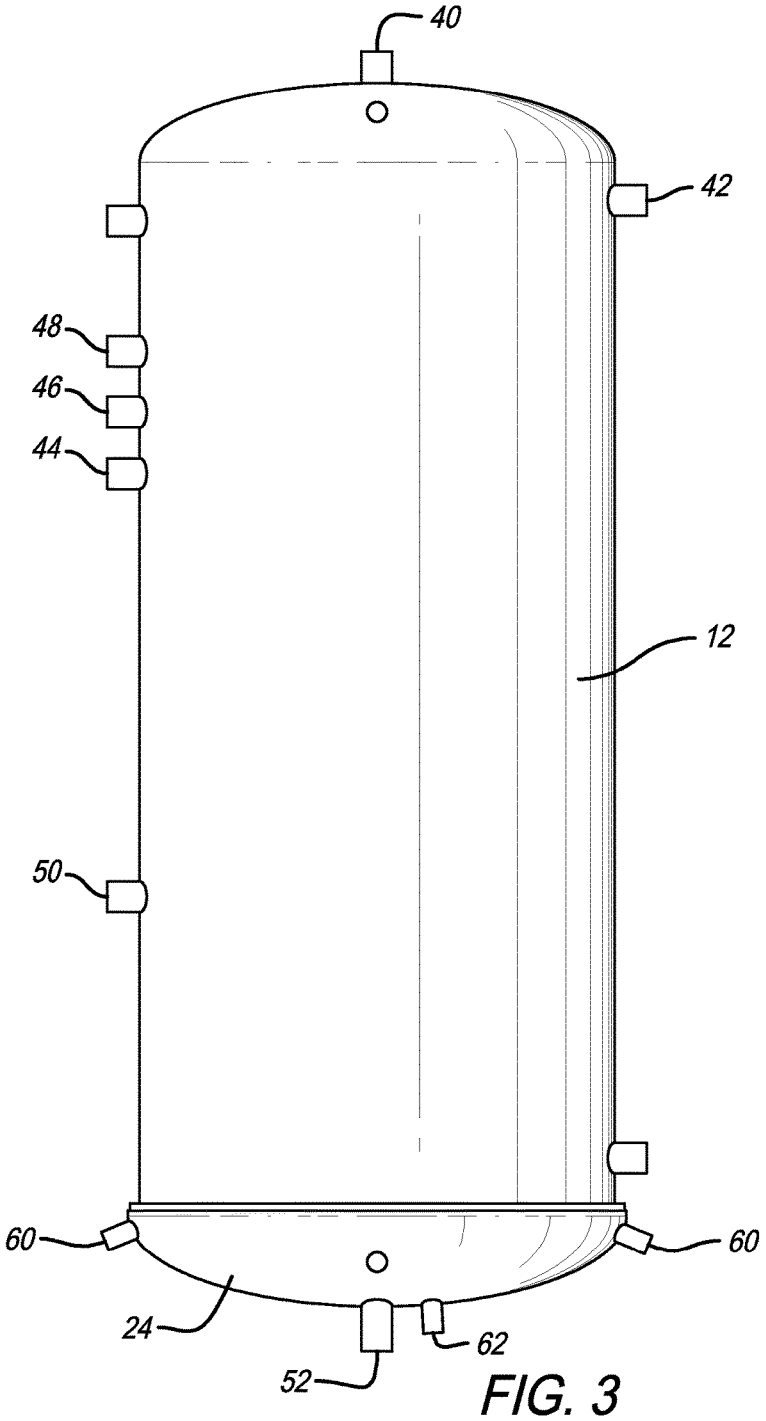
FIG. 3 is an elevational view of the storage vessel.
Figure 4:
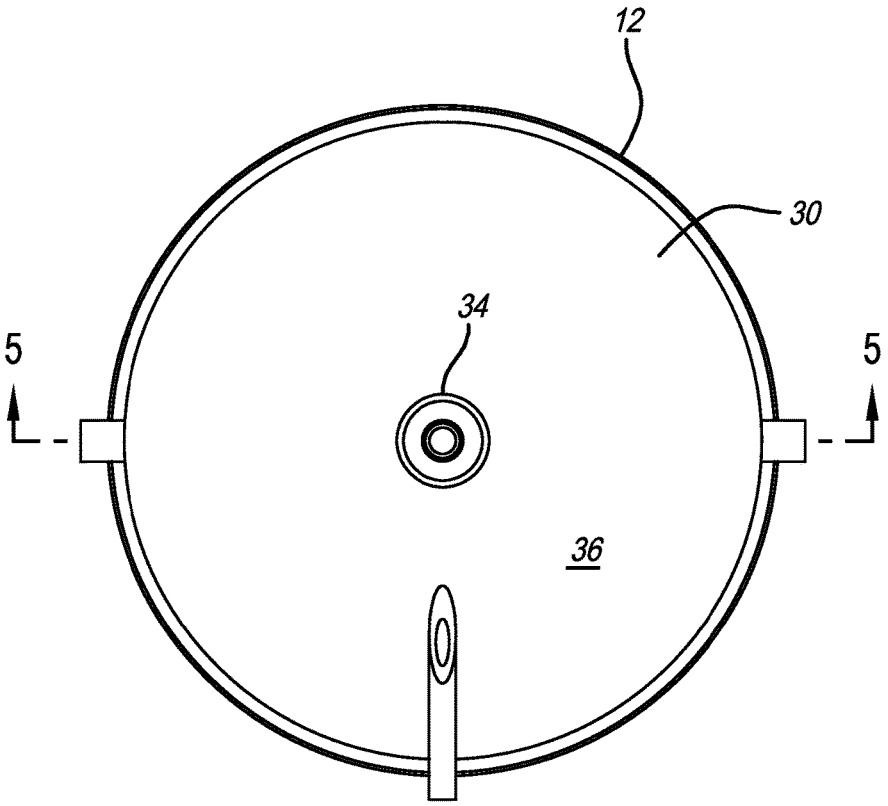
FIG. 4 is a cross-sectional plan view of the storage vessel.

FIGS. 1-5 show a carbon dioxide cleaning or processing system 10 and a storage vessel 12 used therewith. As shown in FIG. 1, in general, the processing system 10 includes storage vessel (SV) 12, a processing vessel (PV) 14, an accumulator vessel (ACC) 16, first and second compressors 18 and 20, first and second heat exchangers 22 and 24 and a carbon dioxide supply 26. The processing system 10 also includes a series of pipes and valves through which liquid and gaseous carbon dioxide flow and that connect the various vessels and components, as will be described further below. It will be appreciated that FIGS. 1 and 2 are piping and instrumentation diagrams that will be understood by those of ordinary skill in the art. Many of the components are known in the art and are therefore not described in detail herein. It will understood that TS-H2O is a water temperature switch, PS-H2O is a water pressure switch, PT-SV is a Pressure transmitter or sensor for the storage vessel, PT ACC is a pressure sensor for the accumulator vessel, PT PV is a pressure sensor for the processing vessel, TT PV is a temperature sensor for the processing vessel, FPT are pipe fittings, DL is a door lock switch, DT is a door close switch, RV-1 to RV-7 are relief valves, AV-1 to AV-14 are automatic ball valves (e.g., pneumatic), EV-1 to EV-12 are electronic solenoid valves, MV-1 to MV-12 are manual valves. It will be appreciated that the types of valves are interchangeable and that not all valves are shown, but can be added as desired and needed for a particular embodiment. The system 10 also can include a motor 70, trap 72, steam trap 74, pump 76 and other components known in the art.

FIGS. 2-5 illustrate the storage vessel 12, which generally includes a storage vessel interior 28, an upper section 30, a lower section 32, and a standpipe 34 that communicates the upper section 30 and the lower section 32. A dividing wall 36 spans and divides the storage vessel interior 28 into the upper section 30 and the lower section 32. The dividing wall 36 includes an opening 38 defined therein that communicates with the standpipe 34. In an exemplary embodiment, the dividing wall 36 is a metal disc that is seal welded inside the storage vessel 12 and the standpipe is seal welded into the center of the dividing wall 36 such that the hollow opening of the standpipe aligns with opening 38. It will be appreciated that the storage vessel can be two separate containers or tanks connected by a pipe or standpipe. The upper and lower sections do not have to be directly above and below one another. The pipe can extend at a non-vertical angle therebetween. Also, the dividing wall can be a membrane or any type of separator between the sections.

Throughout the description herein the liquid carbon dioxide may be referred to as clean liquid and dirty liquid. It will be appreciated that the clean liquid is the carbon dioxide liquid prior to being used to process the objects to be cleaned and the dirty liquid is the carbon dioxide liquid after being used to process the objects to be cleaned and prior to being distilled. Within the storage vessel 12, the clean liquid is generally stored in the upper section 30 and the dirty liquid is generally stored in the lower section 32. Furthermore, it will be appreciated that the system described herein can be used to process any number of objects as is known in the prior art. For example, the system can be used for cleaning objects such as metals or porcelain or extracting oils from substrates. As described herein, the processing system 10 is used to clean clothes. However, this is not a limitation and is only exemplary.

In a preferred embodiment, the storage vessel 12 includes the first heat exchanger 22 for cooling the gaseous carbon dioxide in the upper section to condense the gas and form liquid carbon dioxide (clean liquid). The first heat exchanger 22 can be any device capable of cooling and condensing the gas. In a preferred embodiment, the first heat exchanger includes cold water coming in on one side, which cools a plate, and the carbon dioxide gas coming in the other side, which is cooled by the plate below its liquid point and is thereby condensed into clean liquid. In another embodiment, the first heat exchanger can be a jacket that surrounds the top of the storage vessel 12 and is filled with cooling water or refrigeration gas. This could eliminate the piping to sent the gas to the first heat exchanger and the pipe for the liquid coming back. Preferably, the storage vessel 12 also includes a second heat exchanger 24 for heating the liquid carbon dioxide (dirty liquid) in the lower section 32 (also referred to herein as the still) to distill it into a gas so that it rises through the standpipe 34 and into the upper section 30 (where it is condensed as described above). The second heat exchanger 24 can be any device capable of heating and distilling the liquid. In a preferred embodiment, the second heat exchanger 24 is a heat jacket that can be filled with a heated fluid, such as water or steam to heat up the bottom of the storage vessel 12. In another embodiment, the second heat exchanger can be omitted and the dirty liquid can be heated as described below through the compressor(s).

Figure 5:
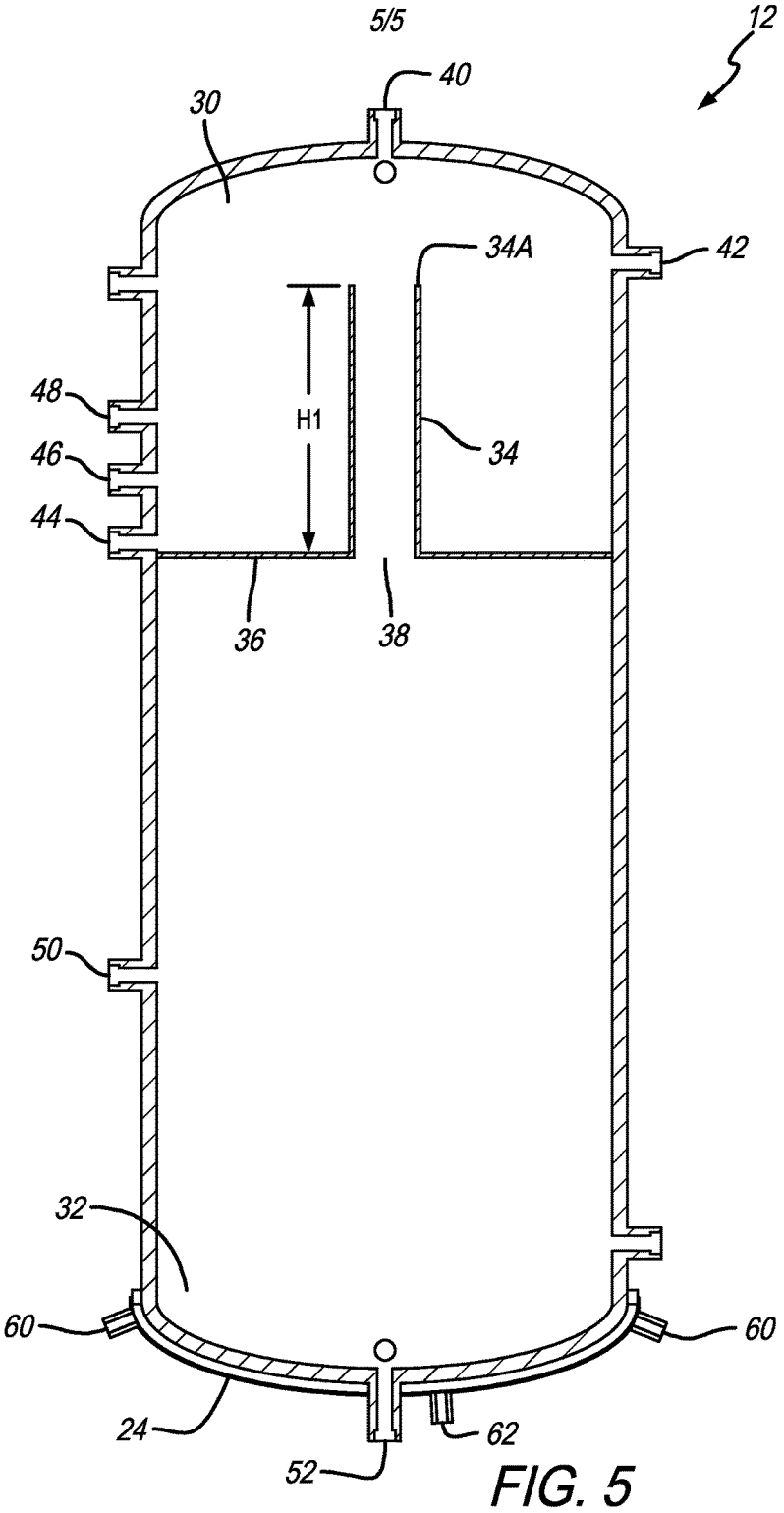
FIG. 5 is a cross-sectional elevational view of the storage vessel.

As shown in FIG. 5, in a preferred embodiment, the standpipe 34 defines an overflow height H1. The overflow height is preferably measured between the upper surface of the dividing wall 36 (i.e., the bottom of the upper section 30) and a top 34*a* of the standpipe 34. It will be appreciated that the upper section 30 is configured to hold a predetermined volume of clean liquid. As a result, when the upper section 30 is filled with the predetermined volume of clean liquid, any excess clean liquid flows over the top 34*a* of the standpipe 34 and drains via gravity into the lower section 32. In other words, the upper section 30 has a storage area (below the top level of the standpipe 34), and if that storage area gets over full with liquid, the liquid flows over the top 34*a* of the standpipe 34 and travels back down into the lower section 32.

In use, gaseous carbon dioxide flows upwardly or rises from the lower section 32, through opening 38 and standpipe 34 and into the upper section 30 and overflow liquid carbon dioxide flows from the upper section 30, through standpipe 34 and opening 38 and down into the lower section 32.

As shown in FIGS. 2-5, the storage vessel 12 includes a number of inlets and outlets or nozzles for flowing carbon dioxide into and out of the upper and lower sections 30 and 32 and for connecting other components such as valves, levels, etc. The number of inlets and outlets shown is not a limitation on the present invention and there can be more or less than is shown.

As shown in FIG. 5, in a preferred embodiment, the storage vessel 12 includes a first gas outlet 40 through which gaseous carbon dioxide flows so that it can pass through the first heat exchanger 22 and be condensed into liquid. In a preferred embodiment, the first gas outlet 40 is located at about the top dead center of the storage vessel 12. However, this is not a limitation. The first gas outlet 40 can also be connected to a relief valve (RV). Or, a relief valve can be connected to a separate outlet. Preferably, the storage vessel 12 also includes a first clean liquid inlet 42 for flowing clean liquid carbon dioxide into the storage vessel 12. In a preferred embodiment, the first inlet 42 is located in the upper section 30 at about the level of the top of the standpipe 34. However, in another embodiment, the first inlet 40 can be located in the lower section 32 or higher up in the upper section 30. In a preferred embodiment, gaseous carbon dioxide is cooled by the first heat exchanger 22 outside of the storage vessel interior 28 and then flows into the upper section 30 as a liquid. However, in another embodiment, the condensing step can take place in the storage vessel interior 28.

In a preferred embodiment, the storage vessel 12 includes at least a first 44 and preferably first 44, second 46 and third 48 clean liquid outlets. As shown in FIG. 5, the first 44, second 46 and third 48 clean liquid outlets are positioned at first, second and third heights from the dividing wall 36. This provides the ability to flow different amounts or volumes of clean liquid out of the upper section 30 (through AV-12) and to the processing vessel 14. This capability can be used for small, medium or large loads of clothes or other objects. For example, if first clean liquid outlet 44 is used, a first volume of fluid will flow out of the upper section (essentially all of the clean liquid) (e.g., for a large load of clothes or other objects). If the second clean liquid outlet 46 is used, a second volume of clean liquid will flow out (smaller than the first volume) (e.g., for a medium load of clothes or other objects). If the third clean liquid outlet 48 is used, a third volume of clean liquid will flow out (smaller than the second volume) (e.g., for a small load of clothes or other objects). In another example, the third clean liquid outlet 48 can be used for a first wash, the second clean liquid outlet 46 can be used for a first rinse, and the first clean liquid outlet 44 can be used for a second rinse. This can provide options for a user, such as a dry cleaner. Typically, the full volume of clean liquid is used for a complete cycle of liquid and the upper section is completely empty at the end of a cycle and the entire volume is now in the processing vessel 14.

As shown in FIG. 5, in a preferred embodiment, the lower section 32 includes a first dirty liquid inlet 50. Dirty liquid from the processing vessel 14 that includes a contaminant/solubilized material (e.g., oil removed from the clothes in detergent) flows through the first dirty liquid inlet 50 and into the lower section 32 or still section. The lower section 32 also preferably includes a first dirty liquid outlet 52. The principal purpose of the first dirty liquid outlet 52 is to get the residue (e.g., contaminants from the clothes) off the bottom of the lower section 32. It is essentially a drain. However, in a preferred embodiment, the piping is arranged so that the hot compressor gas (described below) flows in through the same nozzle. In a preferred embodiment, the first dirty liquid outlet 52 is located at the bottom center of the storage vessel 12. However, this is not a limitation.

FIG. 5 also shows the inlets and outlets on the second heat exchanger 24 or heat jacket. In a preferred embodiment, the heat jacket 24 includes at least one and preferably two steam inlets 60 and a water/condensate outlet 62.

It will be appreciated that the storage vessel 12 can be made of any material, but that it is preferably made of metal to withstand the high pressures in the system. In a preferred embodiment, the lower portion of the storage vessel 12 is made of stainless steel and the upper portion is made of carbon steel. Dividing line 64 in FIG. 2 shows the separation between the two materials. During the dry cleaning process, the dirty liquid often contains corrosive solubilized material. These materials sit in the lower section 32. Stainless steel can withstand the corrosive materials. However, it will be understood by those of ordinary skill in the art that stainless steel is generally more expensive than carbon steel. Therefore, instead of making the entire storage vessel 12 of stainless steel, at least a portion of the lower section 32 can be made of stainless steel and the remainder of the storage vessel 12 can be made of carbon steel, to reduce costs. In another embodiment, the entire storage vessel 12 can be made of stainless steel or other material impervious to the corrosive effects of the liquids.

With reference back to FIG. 1, the remainder of the processing system 10 will now be described. Generally, clean liquid is flowed from the upper section 30 of the storage vessel 12 to the process vessel 14 (through first, second or third clean liquid outlet 44, 46 or 48), where it is used to process the objects in the process vessel 14 (e.g., cleaning clothes after a detergent is added). The now dirty liquid is then flowed from the process vessel 14 to the lower section 32 of the storage vessel 12 (through first dirty liquid inlet 50). The dirty liquid is then distilled into gas that rises to the upper section 30 through standpipe 34. The gas exits through first gas outlet 40 and is condensed to clean liquid in the first heat exchanger 22. The clean liquid reenters the upper section through first clean liquid inlet 42. As shown in FIG. 1, in a preferred embodiment, the processing vessel 14 is positioned such that clean liquid flows from the upper section 30 to the process vessel via gravity, and dirty liquid flows from the processing vessel 14 to the lower section 32 via gravity. To make this happen, the first, second and third clean liquid outlets 44, 46 or 48 are positioned higher than the inlet on the processing vessel 14 and the first dirty liquid inlet 50 is positioned lower than the inlet on the processing vessel 14. This positioning is not a limitation on the present invention. In another embodiment, pumps can be used to move the liquid instead of gravity. Pumps and gravity can also be used.

At this point in the process the clothes have been cleaned and the dirty liquid has been drained to the storage vessel, but the processing vessel 14 is pressurized. We now want to reclaim the carbon dioxide gas from the processing vessel 14, which is pressurized at a first pressure. At this point, the processing vessel 14 and storage vessel 12 are both at the first pressure.

For exemplary purposes only, and to further understand the process described above, assume 800 psi is the first pressure. In a preferred embodiment, at least the first compressor 18 is used to pull the carbon dioxide gas from the processing vessel 14 and flow it to the storage vessel 12. However, in a more preferred embodiment, the gas side of the processing system 10 includes the first compressor 18, the accumulator vessel 16 and the second compressor 20. In a preferred embodiment, to depressurize the processing vessel 14 to a point where the door can be opened, the system includes a high pressure step and a low pressure step. In another embodiment, the pressurized carbon dioxide gas in the processing vessel 14 can be vented instead of being reclaimed.

Those of ordinary skill in the art understand the ideal gas law, PV=nRT (P is the pressure of the gas, V is the volume of the gas, N is the amount of substance of gas (also known as number of moles), R is the ideal gas constant, and T is the temperature of the gas. At the beginning of the high pressure step (when the pressure vessel 14 is at the first pressure), the gas is pulled from the processing vessel 14 by the first compressor and it flows along a first pressure path P1. As is shown in FIG. 1, the gas flows upwardly from the top of the processing vessel 14, through automated valve AV-10, through the first compressor 18, through automated valve AV-8 and into the lower section 32 of the storage vessel 12. As the gas is pulled from the processing vessel 14 it drops the pressure in the fixed volume processing vessel 14. As a result, the temperature drops in the processing vessel 14 at the rate the gas is pulled from the processing vessel 14. Conversely, the gas that flows through the first compressor 18 is heated (as a result of being compressed). The hot gas then flows into the lower section 32 of the storage vessel 12. As described above, in a preferred embodiment, the hot gas then flows in through the first dirty liquid outlet 52. In another embodiment, a separate inlet/nozzle can be provided for the hot gas. It will be appreciated that the hot gas is being directed into the dirty liquid from the wash cycle that just ended and is contained in the lower section 32 of the storage vessel 12. Therefore, the pressure in the processing vessel 14 is dropping while hot compressed gas is being blown into the storage vessel 12, which causes the dirty liquid temperature to increase and to start to distill. As the distilled gas rises through the standpipe 34, the first heat exchanger 22 cools the distilled gas and condenses it (to clean liquid for the next cycle) to keep the pressure constant in the storage vessel 12 at the first pressure.

At this point in the exemplary process the pressure in the process vessel 14 has dropped to about half, e.g., about 400 psi. Preferably, the storage vessel 12 and the processing vessel 14 have about the same volume. Due to the condensing portion of the process happening in the storage vessel 12, the storage vessel 12 stays at a relatively constant pressure while the pressure in the pressure vessel 14 is dropping. Therefore, both the upper section 30 and the lower section 32 of the storage vessel 12 are at about 800 psi.

While the high pressure step is taking place, the accumulator vessel 16 is at a second pressure as a result of the previous cycle. For exemplary purposes, the second pressure is 250 psi. The high pressure step continues until the pressure in the processing vessel 14 is approximately the same as the pressure in the accumulator vessel 16, i.e., the second pressure (in this example about 250 psi). The storage vessel 12 is still at the first pressure (about 800 psi) as it continues distilling and condensing.

Once the pressure in the processing vessel 14 and accumulator vessel 16 are both at about the second pressure, the low pressure or second step begins by switching the valving (e.g., automated valve AV-6 is opened) so that the gas being pulled from the processing vessel 14 follows a second pressure path P2 that flows through the second compressor (the low pressure compressor) 20, the accumulator vessel 16 and the first compressor 18 (the high pressure compressor). As shown in FIG. 1, the gas path is from the processing vessel 14, up and over through automated valve AV-6, through the second compressor 20, through automated valve AV-7, through the accumulator vessel 16, through automated valve AV-13, through the compressor, through automated valve AV-8, and into the storage vessel 12. The second step continues until the pressure in the processing vessel 14 is reduced to a third pressure at which time the compressors are shut off (any remaining pressure/gas is vented) and the door to the processing vessel 14 can be opened. This may be, for example, about 30 psi. In an exemplary embodiment, the first compressor 18 is about a fifteen horsepower compressor and the second compressor 20 is a five horsepower compressor. However, this not a limitation and any size compressors can be used. In another embodiment a single compressor can be used.

Describing the end of the low pressure step in more detail and using the foregoing example, the pressure of the processing vessel has gone from about 250 psi (the second pressure) down to about 30 psi (the third pressure). Preferably, the same flow rate of gas flows through the accumulator vessel (e.g., 1 cubic foot per minute) and through the second compressor 20. The flow rate to the first compressor 18 is set at approximately the same flow rate (e.g., 1 cubic foot per minute). Because the first compressor 18 is compressing further the first compressor 18 takes more energy—about three times the second compressor 20, which is why the second compressor 20 is five horsepower in the example and the first compressor 18 is fifteen horsepower. When the processing vessel 14 goes from 250 psi down (the second pressure) to about 30 psi (the third pressure), the accumulator vessel 16 stays at about 250 psi (the second pressure) and the heat goes through the first compressor 18 and to the storage vessel 12. It will be appreciated that it is almost the same rate that is required to distill the volume dirty liquid in the bottom of the storage vessel 12. Once the pressure vessel 14 reaches the third pressure, at least the second compressor 20 shuts off If desired (depending on how much gas is desired to be reclaimed), the first compressor 18 can continue to pull the pressure in the accumulator vessel 16 down. In a preferred embodiment, the first compressor 18 can run up to about a 10 to 1 ratio, which means it can pull the accumulator vessel 16 down to about 75 psi while SV 12 is at 750 psi. If it is not desired to further depressurize the accumulator vessel 16, once the pressure vessel 14 reaches the third pressure both compressors can be shut off The 75 psi is the pressure where dry ice is formed. Therefore, if the accumulator vessel 16 is below 75 psi dry ice cannot form and the accumulator vessel 16 is ready at the beginning of the next cycle with 75 psi in it. Preferably, the accumulator vessel 16 is about the same volume as the processing vessel 14. Therefore, at the 75 psi pressure, the accumulator vessel 16 can be used to purge air from the processing vessel 14 (prior to washing) without the worry of getting dry ice in the processing vessel (which can be abrasive to the material being processed).

It will be appreciated by those of ordinary skill in the art that the first and second steps are done to capture the heat of compression off the high pressure compressor into the dirty liquid in the bottom of the storage tank 12 to help distilling so another energy source does not have to be used or at least less energy from another source can be used. Moreover, it will be appreciated that the accumulator vessel 16 serves two functions. First, it provides storage of some gas so air can be purged out of the processing vessel at the beginning of the cycle (e.g., after the door is closed, but before the clothes are washed). Second, the accumulator vessel 16 acts as a buffer between the second and first compressors 20 and 18.

It will be appreciated that FIG. 1 shows other piping branches that are not described in detail herein. One of ordinary skill in the art will understand that these branches are included to provide processing options for users of the system. For example, in an application where it is desirable to apply hot vapor to the processing vessel to drive off liquid, the hot vapor may follow a path from ACC 16, through AV-13, through the first compressor 18, down around and up through AV-14 and into the top of PV 14. Other processing options will be apparent to those of ordinary skill in the art.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize Further, any specific numbers noted herein are only examples: alternative implementations may employ differing values, measurements or ranges. It will be appreciated that any dimensions given herein are only examplary and that none of the dimensions or descriptions are limiting on the present invention.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A system for processing objects to be cleaned, the system comprising:

a processing vessel, a storage vessel that includes an upper section for storing clean liquid and a lower section for storing dirty liquid, wherein the upper section and lower section are in flow communication, wherein the upper section includes a first heat exchanger, wherein gas received from the lower section is cooled by the first heat exchanger to condense the gas to form the clean liquid to be stored in the upper section, wherein the lower section includes a second heat exchanger, wherein dirty liquid stored in the lower section is heated by the second heat exchanger to form a gas that rises into the upper section for condensation by the first heat exchanger, a first compressor, an accumulator vessel, and a second compressor, a first pressurized gas path from the processing vessel through a first set of pipes and to the first compressor, through the first compressor, through a second set of pipes and to the lower section of the storage vessel, and a second pressurized gas path from the processing vessel through a third set of pipes to the second compressor, through the second compressor, through a fourth set of pipes to the accumulator vessel, through the accumulator vessel, through a fifth set of pipes to the first compressor, through the first compressor, through the second set of pipes and to the lower section of the storage vessel.

2. The system of claim 1 wherein the upper section and lower section are in flow communication by a standpipe.

3. The system of claim 1 wherein the first heat exchanger includes a cooling plate.

4. The system of claim 3 wherein an overflow height is defined between a bottom of the upper section and a top of the standpipe, wherein the upper section includes a storage portion that is configured to hold a predetermined volume of clean liquid, whereby when an excess of clean liquid beyond the predetermined volume of clean liquid is present in the upper section the excess of clean liquid flows over the top of the standpipe and into the lower section.

5. The system of claim 4 wherein the lower section and upper section are separated by a dividing wall, and wherein the overflow height is defined between the dividing wall and the top of the standpipe.

6. The system of claim 5 wherein the storage vessel and processing vessel are positioned such that clean liquid flows to the processing vessel via gravity and dirty liquid flows to the lower section via gravity.

7. The system of claim 3 wherein the second heat exchanger comprises a heat jacket.

8. A system for processing objects to be cleaned, the system comprising:

a processing vessel, a first storage section for storing clean liquid, wherein the first storage section includes a first heat exchanger, a second storage section for storing dirty liquid, wherein the second storage section includes a second heat exchanger, wherein dirty liquid stored in the second storage section is heated by the second heat exchanger to form a gas that flows to the first storage section, wherein the gas received in the first storage section is cooled by the first heat exchanger to condense the gas to form the clean liquid to be stored in the first storage section, a first compressor, an accumulator vessel, and a second compressor, a first pressurized gas path from the processing vessel through a first set of pipes and to the first compressor, through the first compressor, through a second set of pipes and to the second storage section, and a second pressurized gas path from the processing vessel through a third set of pipes to the second compressor, through the second compressor, through a fourth set of pipes to the accumulator vessel, through the accumulator vessel, through a fifth set of pipes to the first compressor, through the first compressor, through the second set of pipes and to the second storage section, wherein the system is configured to process gas at a first pressure through the first pressurized gas path to cause a pressure drop in the processing vessel and to cause at a least a portion of the dirty liquid in the second storage section to vaporize, wherein the system is configured to further process gas through the second pressurized gas path after the pressure in the processing vessel has dropped to a predetermined second pressure.

* * * * *